US010085079B2

(12) United States Patent
Sato et al.

(10) Patent No.: US 10,085,079 B2
(45) Date of Patent: Sep. 25, 2018

(54) LOUDSPEAKER AND LOUDSPEAKER STRUCTURE

(71) Applicant: Panasonic Intellectual Property Management Co., Ltd., Osaka (JP)

(72) Inventors: Hitoshi Sato, Mie (JP); Kazuma Fujioka, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/513,061

(22) PCT Filed: Sep. 18, 2015

(86) PCT No.: PCT/JP2015/004794

§ 371 (c)(1),
(2) Date: Mar. 21, 2017

(87) PCT Pub. No.: WO2016/056183

PCT Pub. Date: Apr. 14, 2016

(65) Prior Publication Data

US 2017/0303024 A1 Oct. 19, 2017

(30) Foreign Application Priority Data

Oct. 9, 2014 (JP) ..... 2014-207912

(51) Int. Cl.
*H04R 1/02* (2006.01)
*H04R 1/06* (2006.01)
(Continued)

(52) U.S. Cl.
CPC ..... *H04R 1/025* (2013.01); *H04R 1/06* (2013.01); *H04R 1/20* (2013.01); *H04R 7/02* (2013.01);
(Continued)

(58) Field of Classification Search
CPC . H04R 1/025; H04R 7/16; H04R 7/02; H04R 1/06; H04R 1/20; H04R 9/045; H04R 2201/025; H04R 2400/11; H04R 2440/05
(Continued)

(56) References Cited

U.S. PATENT DOCUMENTS 4,470,178 A * 9/1984 Matsui ..... F16B 5/065 174/138 D
4,629,356 A * 12/1986 Hayashi ..... F16B 5/065 174/138 D
(Continued)

FOREIGN PATENT DOCUMENTS

| | | |
|---|---|---|
| JP | 60-032883 U | 3/1985 |
| JP | 64-039156 U | 3/1989 |
| JP | 64-044782 U | 3/1989 |
| JP | 4-034091 U | 3/1992 |
| JP | 2005-065245 | 3/2005 |

OTHER PUBLICATIONS

International Search Report of PCT application No. PCT/JP2015/004794 dated Dec. 15, 2015.

*Primary Examiner* — Oyesola C Ojo
(74) *Attorney, Agent, or Firm* — Greenblum & Bernstein, P.L.C.

(57) ABSTRACT

A loudspeaker includes a diaphragm, a frame, an attachment unit, and a fixing member. The frame has a front surface, a mounting surface disposed on a side opposite to the front surface, and a wall surface disposed in a standing manner from the mounting surface. And the frame holds an outer peripheral edge of the diaphragm. The attachment unit includes: a base portion having a top surface facing the mounting surface, a bottom surface on a side opposite to the top surface, a first side surface facing the wall surface, and a second side surface disposed on a side opposite to the first side surface; a first base rib projecting toward the wall surface from the first side surface; a second base rib projecting from the second side surface and extending to the top
(Continued)

surface; and a locking portion disposed on a side near the bottom surface of the base portion. The fixing member penetrates the frame from the front surface to the mounting surface and is fixed to the base portion by screwing.

7 Claims, 11 Drawing Sheets

(51) Int. Cl.
*H04R 1/20* (2006.01)
*H04R 7/02* (2006.01)
*H04R 7/16* (2006.01)

(52) U.S. Cl.
CPC ..... *H04R 7/16* (2013.01); *H04R 1/02* (2013.01); *H04R 2201/021* (2013.01); *H04R 2400/11* (2013.01)

(58) Field of Classification Search
USPC ..... 381/386
See application file for complete search history.

(56) References Cited

U.S. PATENT DOCUMENTS 6,042,296 A * 3/2000 Wittig ..... F16B 5/0642 24/297
6,305,892 B1 * 10/2001 Qiao ..... F16B 5/065 411/508
6,581,252 B1 * 6/2003 Sedlock ..... F16B 5/065 24/297
6,971,831 B2 * 12/2005 Fattori ..... F16B 21/082 16/2.1
7,717,227 B2 * 5/2010 Kusano ..... H04R 1/025 181/148
7,798,740 B2 * 9/2010 Kaufman ..... F16B 12/38 211/189
9,774,937 B2 * 9/2017 Shiojima ..... H04R 1/026
2004/0208728 A1 * 10/2004 Fattori ..... F16B 21/082 411/508
2006/0092616 A1 * 5/2006 Yi ..... H05K 7/142 361/804
2007/0274803 A1 * 11/2007 Kusano ..... H04R 1/025 411/81

* cited by examiner

LOUDSPEAKER AND LOUDSPEAKER STRUCTURE

This application is a U.S. national stage application of the PCT International Application No. PCT/JP2015/004794 filed on Sep. 18, 2015, which claims the benefit of foreign priority of Japanese patent application 2014-207912 filed on Oct. 9, 2014, the contents all of which are incorporated herein by reference.

TECHNICAL FIELD

This disclosure relates to a loudspeaker and a loudspeaker structure used in various electronic devices.

BACKGROUND

Hereinafter, a conventional speaker is described with reference to drawings. FIG. 10 is a perspective view showing the configuration of the conventional speaker. FIG. 11 is a perspective view of a main part of the conventional speaker. The speaker 1 includes diaphragm 2, and frame 3 which holds an outer peripheral edge of diaphragm 2.

In such a conventional speaker, attachment unit 5 is fixed to frame 3 on a back surface side of a sound radiation surface of diaphragm 2 by screwing mounting frame 5 from a sound radiation surface side of diaphragm 2 by fixing jigs 4. To strengthen a fixing state between frame 3 and attachment unit 5, in a state where fitting portion 6 of attachment unit 5 is fitted into pocket 7 formed in frame 3, attachment unit 5 is fixed to frame 3 by fixing jigs 4. Then, engaging portions 8 of attachment units 5 are engaged with outer engaging bodies (not shown) so that speaker 1 is fixed to a structure which is an object to which speaker 1 is to be fixed (not shown).

For example, Unexamined Japanese Patent Publication No. 2005-65245 is known as information on prior art literature relating to the invention according to the present application.

SUMMARY

A loudspeaker of this disclosure includes: a diaphragm; and a frame having a front surface, a mounting surface disposed on a side opposite to the front surface, and a wall surface disposed in a standing manner from the mounting surface, the frame holding an outer peripheral edge of the diaphragm. The loudspeaker further includes an attachment unit including: a base portion having a top surface facing the mounting surface, a bottom surface disposed on a side opposite to the top surface, a first side surface facing the wall surface, and a second side surface disposed on a side opposite to the first side surface; a first base rib projecting toward the wall surface from the first side surface; a second base rib projecting from the second side surface and extending to the top surface; and a locking portion disposed on a side near the bottom surface of the base portion. The loudspeaker further includes a fixing member which penetrates the frame from the front surface to the mounting surface and is fixed to the base portion by screwing.

According to this disclosure, it is possible to suppress the occurrence of a state where fixing of the attachment unit becomes inappropriate. That is, the attachment unit absorbs variation in size and the like due to the deformation of the first base rib and the second base rib while maintaining a fixed state by the fixing member. With such an operation, the attachment unit has tolerance in variation in position of the fixed state. Accordingly, even when a fixed state of the attachment unit varies, the variation in the fixed state is not maintained and hence, fixing of the attachment unit can be easily corrected. As a result, the speaker can maintain a stable fixed state. Further, the attachment unit can be easily inserted into a structure which is an object to which attachment unit is to be fixed.

DESCRIPTION OF EMBODIMENT

Figure 1:
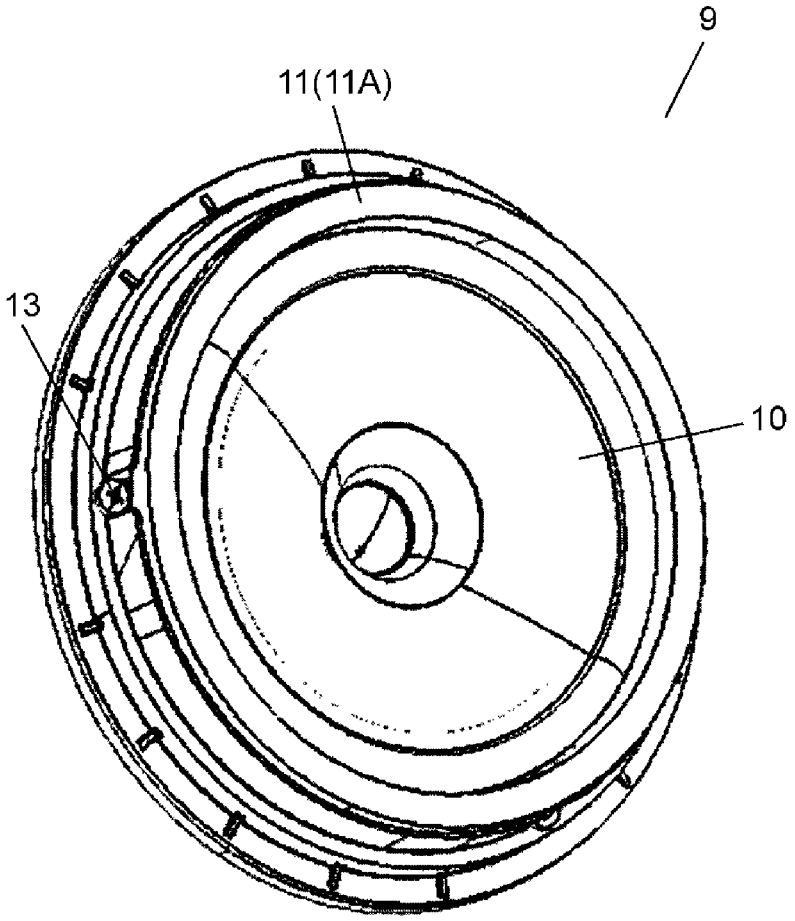
FIG. 1 is a perspective view illustrating the configuration of a loudspeaker according to an exemplary embodiment.

In conventional speaker 1, in order to accurately combine fitting portion 6 and pocket 7 with each other, both fitting portion 6 and pocket 7 are required to satisfy high accuracy in size. This is because in the case where this accuracy in size is lowered, even when a fixed state of attachment unit 5 to pocket 7 becomes inappropriate, attachment unit 5 is maintained in an extremely strongly fixed state by pocket 7. Further, since the fixed state is inappropriate and is strong and hence, attachment unit 5 has small tolerance in variation in position or the like. Accordingly, when engaging portion 8 of attachment unit 5 is engaged with an engaging body, the above-mentioned inappropriate fixed state of attachment unit 5 is maintained without being corrected. That is, due to lowering of accuracy in size of fitting portion 6 and pocket 7, the fixed state of attachment unit 5 becomes inappropriate thus giving rise to a drawback that a fixed state between speaker 1 and the structure becomes unstable.

In view of the above, this disclosure provides a loudspeaker and a loudspeaker structure which can prevent a fixed state of an attachment unit from becoming inappropriate.

Hereinafter, an exemplary embodiment of this disclosure is described with reference to drawings.

EXEMPLARY EMBODIMENT

Figure 2:
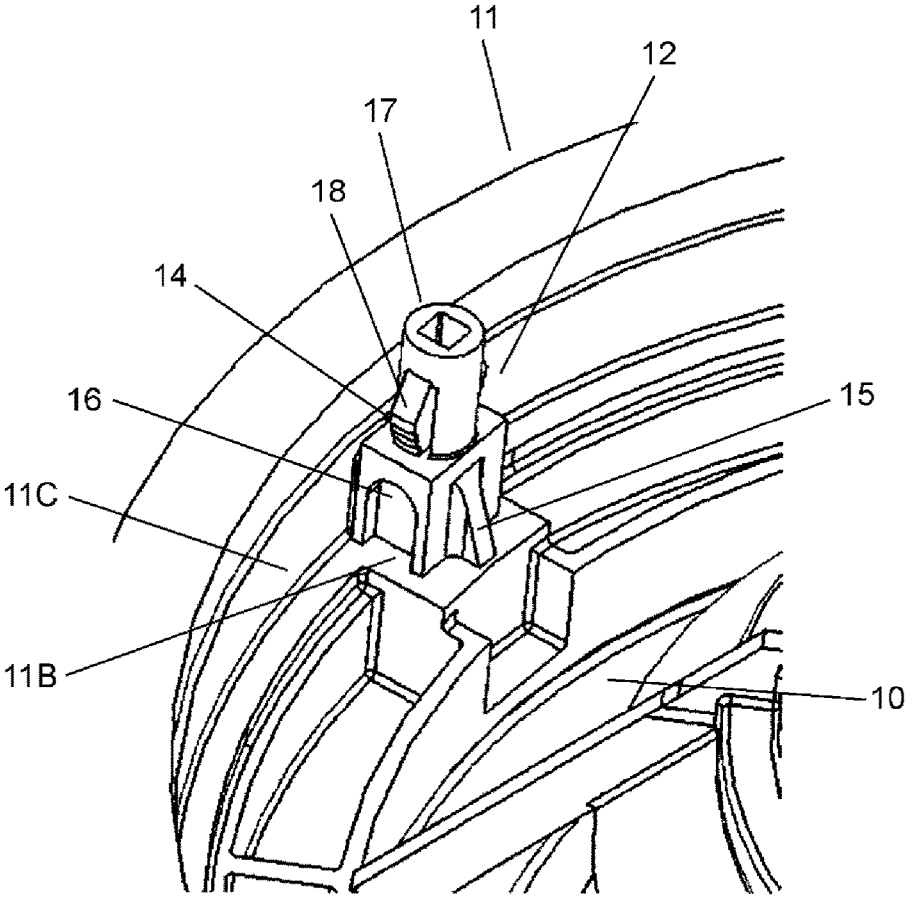
FIG. 2 is a perspective view illustrating a main part of the loudspeaker according to the exemplary embodiment.
Figure 3:
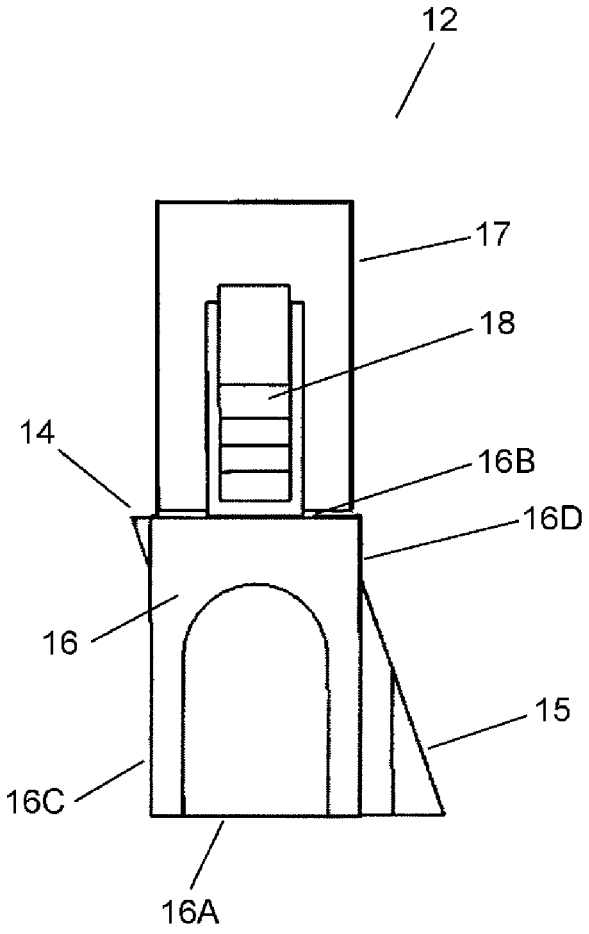
FIG. 3 is a side view illustrating a main part of an attachment unit of the loudspeaker according to the exemplary embodiment.
Figure 4:
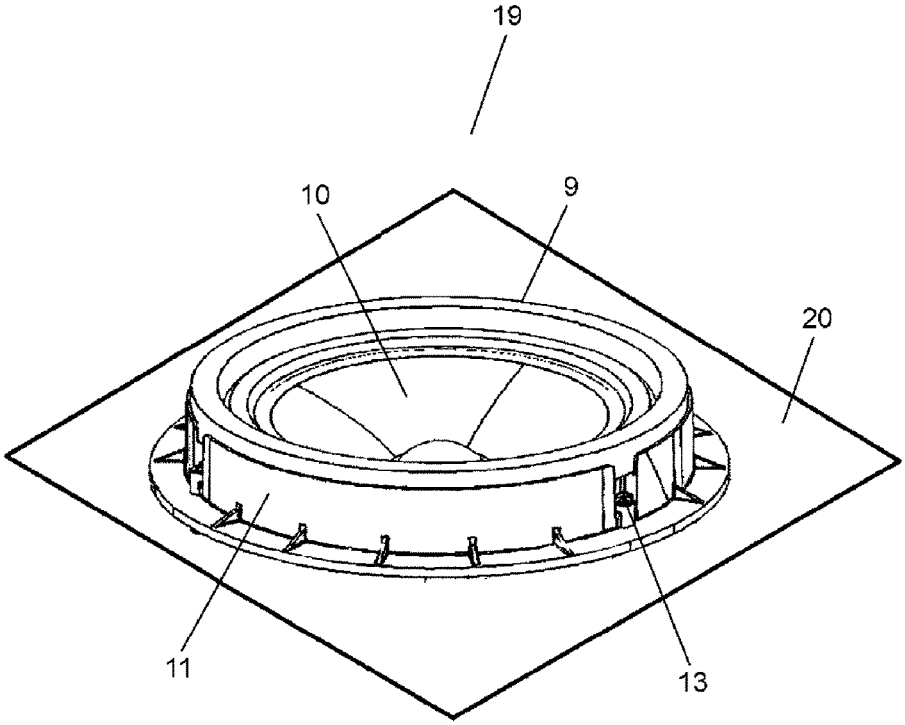
FIG. 4 is a perspective view illustrating a loudspeaker structure according to the exemplary embodiment.
Figure 5:
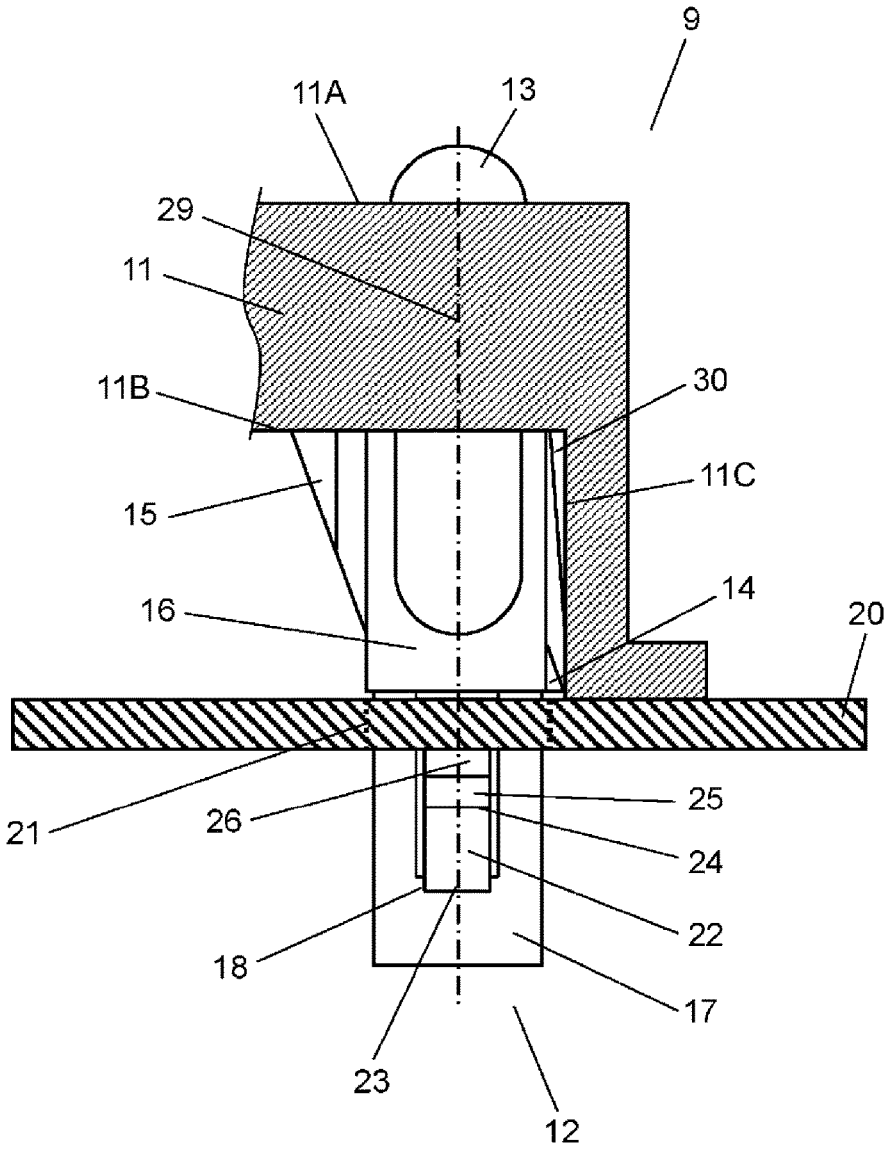
FIG. 5 is a view illustrating structure of a main part of the loudspeaker structure according to the exemplary embodiment.

FIG. 1 is a perspective view illustrating the configuration of a loudspeaker according to an exemplary embodiment, FIG. 2 is a perspective view illustrating a main part of the loudspeaker according to the exemplary embodiment, FIG. 3 is a side view illustrating a main part of an attachment unit of the loudspeaker according to the exemplary embodiment, FIG. 4 is a perspective view illustrating a loudspeaker structure according to the exemplary embodiment, and FIG. 5 is a view illustrating structure of a main part of the loudspeaker structure according to the exemplary embodiment.

Loudspeaker 9 includes diaphragm 10, frame 11, attachment unit 12, and fixing member 13.

Frame 11 has front surface 11A, mounting surface 11B on a side opposite to front surface 11A, and wall surface 11C which is disposed in a standing manner on mounting surface 11B and, at the same time, holds an outer peripheral edge of diaphragm 10.

Attachment unit 12 has: base portion 16 on which first base rib 14 and second base rib 15 are formed; and locking portions 18. Base portion 16 has: top surface 16A which faces mounting surface 11B; bottom surface 16B disposed on a side opposite to top surface 16A; first side surface 16C disposed so as to face wall surface 11C; and second side surface 16D disposed on a side opposite to first side surface 16C. First base rib 14 projects toward wall surface 11C from first side surface 16C of base portion 16. Second base rib 15 projects from second side surface 16D and extends to top surface 16A. Locking portions 18 are disposed on a bottom surface 16B side of the base portion.

Fixing member 13 penetrates frame 11 from front surface 11A to mounting surface 11B, and screws to base portion 16.

Due to the above-mentioned configuration, attachment unit 12 absorbs a variation in size or the like by the deformation of first base rib 14 and second base rib 15 while maintaining a fixed state of attachment unit 12 by fixing member 13. With such a configuration, attachment unit 12 has a tolerance for the variation in position of a fixed state of attachment unit 12. Accordingly, even when the fixed state of attachment unit 12 varies, such a variation in position of the fixed state is not maintained and is easily corrected. As a result, a state where loudspeaker 9 is stably fixed can be maintained. Further, attachment unit 12 can be easily inserted into a structure (not shown) which is an object to which attachment unit 12 is to be fixed.

Attachment unit 12 is fixed to frame 11 on a back surface side of a voice radiation surface by fixing member 13 and, at the same time, is positioned to frame 11 by first base rib 14, second base rib 15, and base portion 16. Further, first base rib 14 and second base rib 15 project from side surfaces of base portion 16 and hence, first base rib 14 and second base rib 15 can be easily deformed upon receiving a stress from the surrounding. Accordingly, attachment unit 12 and frame 11 are mechanically joined to each other with a sufficient fixing force and, at the same time, even when a change in positional relationship, variation in size or the like occurs between attachment unit 12 and frame 11, attachment unit 12 can maintain a mechanical joint state while absorbing such a change in positional relationship and variation in size.

That is, attachment unit 12 has a tolerance for variation in position of a fixed state of attachment unit 12 and hence, even when variation in position occurs in the fixed state of attachment unit 12, such variation in position is not maintained and is eventually easily corrected. As a result, by using attachment unit 12 having ribs in frame 11 of loudspeaker 9, a fixed state of loudspeaker 9 can be stably maintained.

Attachment unit 12 is fixed to frame 11 by fixing member 13 on a single surface and a plurality of points. Accordingly, it is possible to suppress the generation of resonance due to vibrations between attachment unit 12 and frame 11. Further, when an operator mounts loudspeaker 9 on a structure which is an object to which loudspeaker 9 is to be fixed, the operator can easily insert attachment unit 12 into the structure which is an object to which attachment unit 12 is to be fixed with a simple operation.

Hereinafter, the loudspeaker structure which uses a loudspeaker is mainly described in detail. Specifically, FIG. 4 is a perspective view illustrating the loudspeaker structure according to the exemplary embodiment, and FIG. 5 is a view illustrating structure of a main part of the loudspeaker structure according to the exemplary embodiment.

Loudspeaker structure 19 includes: loudspeaker 9; and structure 20 to which loudspeaker 9 is fixed. Loudspeaker 9 is fixed to structure 20 using attachment unit 12 which is fixed to frame 11 using fixing member 13. In this exemplary embodiment, structure 20 may be a box-shaped enclosure, which is disposed on a back surface side of frame 11 and a voice radiation surface of diaphragm 10, or may be a dashboard or an interior board in a cabin.

As described above, loudspeaker 9 and structure 20 are fixed to each other using attachment unit 12. Specifically, structure 20 is held by being sandwiched between base portion 16 and locking portions 18 of attachment unit 12. Locking portions 18 are integrally formed with cylindrical portion 17 of attachment unit 12. Locking portions 18 are retracted into the inside of cylindrical portion 17 when a pressing force is applied to locking portions 18 in a direction toward a center of cylindrical portion 17 from the outside of cylindrical portion 17, and locking portions 18 project to the outside of cylindrical portion 17 when the pressing force is removed. That is, when loudspeaker 9 is pressed to structure 20 from the top to the bottom in FIG. 5, cylindrical portion 17 of attachment unit 12 is inserted into engaging portion 21.

In this step of inserting cylindrical portion 17 into engaging portion 21, locking portions 18 receive a pressing force from the outside of cylindrical portion 17 to the center of cylindrical portion 17. This step is a state where cylindrical portion 17 is gradually inserted into engaging portion 21 while slope portions 22 receive a pressing force from engaging portion 21. In a state where a pressing force is not applied to slope portions 22, each slope portion 22 is formed continuously from connecting portion 23 of locking portion 18 to slope top portion 24 of locking portion 18 in substantially a straight shape such that a projection amount of locking portion 18 is gradually increased.

Thereafter, cylindrical portion 17 is inserted into engaging portion 21 until structure 20 is brought into contact with base portion 16. This is a state where a pressing force that locking portions 18 receive is lowered because engaging portion 21 is brought into contact with stepped portion 25 and stepped portion 26, at which a projection amount of each locking portion 18 is gradually decreased in a stepwise manner, from slope top portion 24, at which the projection amount of locking portion 18 becomes maximum in a state where slope portion 22 does not receive a pressing force. Accordingly, when structure 20 is brought into contact with base portion 16, a pressing force which locking portions 18 receive from engaging portion 21 is small. Further, structure 20 is fixed in a state where structure 20 is sandwiched between stepped portion 26, which is a part of locking portions 18, and base portion 16 in a vertical direction in the drawing.

In a state where structure 20 is sandwiched between stepped portion 26 and base portion 16 in the vertical direction in the drawing, the projection amount of locking portions 18 is increased from stepped portion 26 to stepped portion 25 in a stepwise manner in the direction extending from structure 20 to a tip end of cylindrical portion 17. Accordingly, even when frame 11 and structure 20 receive only a force for separating frame 11 and structure 20 from each other in the vertical direction in the drawing, stepped portions 26 are positioned to function as stoppers and hence, frame 11 and structure 20 are not separated from each other. As a matter of course, when an operator applies a force for separating frame 11 and structure 20 from each other in the vertical direction in the drawing while pressing locking portions 18 toward the center of cylindrical portion 17, frame 11 and structure 20 can be easily separated from each other again.

As described above, frame 11 and structure 20 can be fixed to each other by using attachment unit 12. In order to maintain such a fixing state in a stable manner, it is necessary that attachment unit 12 be surely fixed to frame 11.

In this exemplary embodiment, base portion 16 of attachment unit 12 is fixed to frame 11 by fixing member 13 so that a fixing force between attachment unit 12 and frame 11 is maintained. Further, the position of attachment unit 12 relative to frame 11 is determined by first base rib 14 and second base rib 15 in addition to fixing member 13.

First base rib 14 is formed on base portion 16 at a position which faces wall surface 11C of frame 11 in a substantially sharp shape toward wall surface 11C. Further, first base rib 14 is formed on a side surface of base portion 16 closest to cylindrical portion 17 such that a height of first base rib 14 is gradually increased as first base rib 14 extends toward cylindrical portion 17.

On the other hand, second base rib 15 is formed on base portion 16 at an inner peripheral side of frame 11, that is, on a surface of base portion 16 at a side opposite to the surface of base portion 16 which faces wall surface 11C, and is formed in a substantially sharp shape toward the inner peripheral side of frame 11. Further, second base rib 15 is formed on a side surface of base portion 16 closer to fixing member 13 such that a height of second base rib 15 is gradually increased as second base rib 15 extends toward a fixing member 13.

Both first base rib 14 and second base rib 15 are integrally formed with attachment unit 12 using a resin. Further, a tip end of first base rib 14 is enabled to deform by being brought into contact with wall surface 11C. In the same manner, a tip end of second base rib 15 is enabled to deform by being brought into contact with mounting surface 11B.

For example, in state shown in FIG. 5, when engaging portion 21 shifts leftward in the drawing relative to attachment unit 12, since the tip end of second base rib 15 is deformed, cylindrical portion 17 is engaged with engaging portion 21 in a state where attachment unit 12 has an inclination while maintaining a fixed state of attachment unit 12 by fixing member 13. That is, attachment unit 12 has a tolerance corresponding to the deformation of the tip end of second base rib 15. Accordingly, even when variation in positional relationship occurs between attachment unit 12 and engaging portion 21, the deformation of the tip end of second base rib 15 easily corrects the fixing direction and a fixing state of attachment unit 12. With such a configuration, loudspeaker 9 is fixed to structure 20 in a stable state. Further, such a stable fixing state is maintained.

Attachment unit 12 is fixed to frame 11 by fixing member 13 by a single surface and hence, resonance due to vibrations is not generated between attachment unit 12 and frame 11. Further, first base rib 14 and second base rib 15 are fixed by a point contact and hence, resonance at a specific frequency is not generated.

Further, in mounting loudspeaker 9 on a structure which is an object to which loudspeaker 9 is to be fixed, an operator can mount loudspeaker 9 on the structure by one-touch operation. That is, the operator can easily insert attachment unit 12 into the structure which is an object to which attachment unit 12 is to be fixed with a simple operation.

On the other hand, for example, in FIG. 5, when engaging portion 21 shifts rightward in the drawing relative to attachment unit 12, since the tip end of first base rib 14 is deformed, cylindrical portion 17 is engaged with engaging portion 21 in a state where attachment unit 12 has an inclination while maintaining a fixed state of attachment unit 12 by fixing member 13. In the same manner as the above-mentioned case, attachment unit 12 has a tolerance corresponding to the deformation of the tip end of first base rib 14. Accordingly, even when variation in positional relationship between attachment unit 12 and engaging portion 21 occurs, the deformation of the tip end of second base rib 15 easily corrects a fixing direction and a fixed state of attachment unit 12. With such a configuration, loudspeaker 9 is fixed to structure 20 in a stable state. Further, such a stable fixed state is maintained.

In this exemplary embodiment, first base rib 14 is disposed on base portion 16 at a side closest to cylindrical portion 17 such that a top portion of first base rib 14 faces wall surface 11C. Second base rib 15 is disposed on a side surface of base portion 16 at a side closer to fixing member 13 or disposed on base portion 16 at a side closest to fixing member 13 in a projecting manner toward an inner peripheral in a state where a side surface of second base rib 15 is brought into contact with mounting surface 11B.

A projection amount of second base rib 15 is larger than a projection amount of first base rib 14. The deformation of second base rib 15 is generated by a pressing force from mounting surface 11B, which has an angle of approximately 90 degrees with respect to a projecting direction of second base rib 15. On the other hand, the deformation of first base rib 14 is generated by a pressing force from wall surface 11C which faces a projecting direction of first base rib 14. That is, a pressing force which second base rib 15 receives from mounting surface 11B in a direction perpendicular to axis of attachment unit 29 is low, and a pressing force which first base rib 14 receives from wall surface 11C in a direction perpendicular to axis of attachment unit 29 is high. Accordingly, by setting the projection amount of second base rib 15 larger than the projection amount of first base rib 14, a pressing force generated by the deformation of first base rib 14 and a pressing force generated by the deformation of second base rib 15 are substantially equal. In this manner, a pressing force which finally corrects a fixed state or a fixing direction of attachment unit 12 becomes substantially identical between first base rib 14 and second base rib 15 when the above-mentioned fixed state of attachment unit 12 varies becomes substantially equal between first base rib 14 and second base rib 15.

Further, by providing second base rib 15, an area that attachment unit 12 supports frame 11 around diaphragm 10 is increased. That is, a mechanical strength of a portion of frame 11 which is liable to receive vibrations from diaphragm 10 is increased.

Accordingly, in addition to the structure where loudspeaker 9 is fixed to structure 20 in a stable manner as described previously, frame 11 holds diaphragm 10 in a stable manner. Frame 11 and structure 20 are fixed to each other on a single surface using fixing member 13 by attachment unit 12 and, further, first base rib 14 and second base rib 15 are fixed by a point contact. Accordingly, resonance at a specific frequency is not generated between frame 11 and attachment unit 12. With such a configuration, mixing of noises, undesired vibrations and the like to diaphragm 10 from frame 11 can be suppressed so that loudspeaker 9 reproduces a sound close to an original sound.

Figure 6:
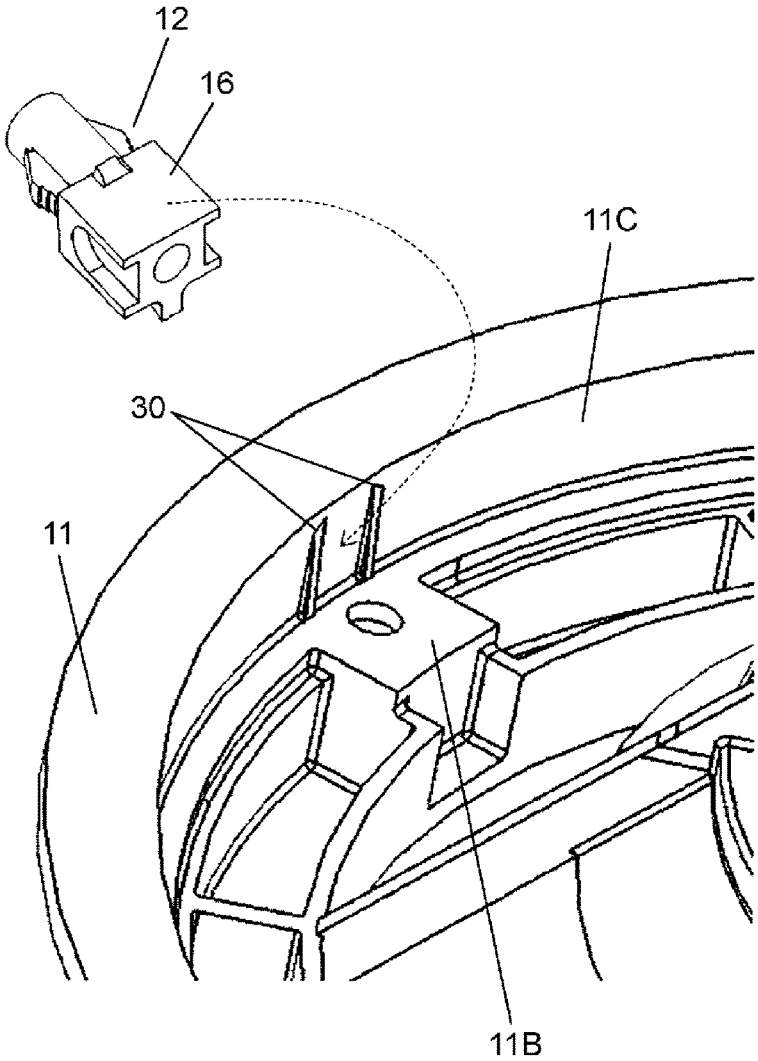
FIG. 6 is a perspective view illustrating a main part of a frame portion of the loudspeaker according to the exemplary embodiment.

FIG. 6 is a perspective view illustrating a main part of the frame portion of the speaker according to the exemplary embodiment. As shown in FIG. 6, wall surface ribs 30 may be formed on a surface of wall surface 11C of frame 11 which faces base portion 16.

In this exemplary embodiment, as described previously, wall surface 11C and mounting surface 11B are formed on frame 11 on a back surface side of the sound radiation surface. Further, wall surface ribs 30 are formed on wall surface 11C, and wall surface ribs 30 are brought into contact with base portion 16 of attachment unit 12 in a state where attachment unit 12 is fixed to mounting surface 11B. Further, wall surface ribs 30 are formed such that a height of wall surface rib 30 is gradually increased as wall surface rib 30 extends from a back surface side of a sound radiation surface to the sound radiation surface.

With such a configuration, base portion 16 of attachment unit 12, especially the bottom surface of base portion 16, is positioned in a stable manner. That is, a position where base portion 16 and mounting surface 11B are connected and fixed to each other becomes stable. Further, base portion 16 and frame 11 are supported by three portions, that is, first base rib 14, second base rib 15, and wall surface ribs 30 of attachment unit 12. All of first base rib 14, second base rib 15, and wall surface ribs 30 are deformable, and these components have a function of properly correcting the positional relationship between loudspeaker 9 and structure 20, and a function of maintaining the corrected state. As a result, a fixed state of attachment unit 12 becomes stable and hence, loudspeaker 9 is fixed to structure 20 in a stable manner, and such a fixed state is maintained.

First Variation

Figure 7:
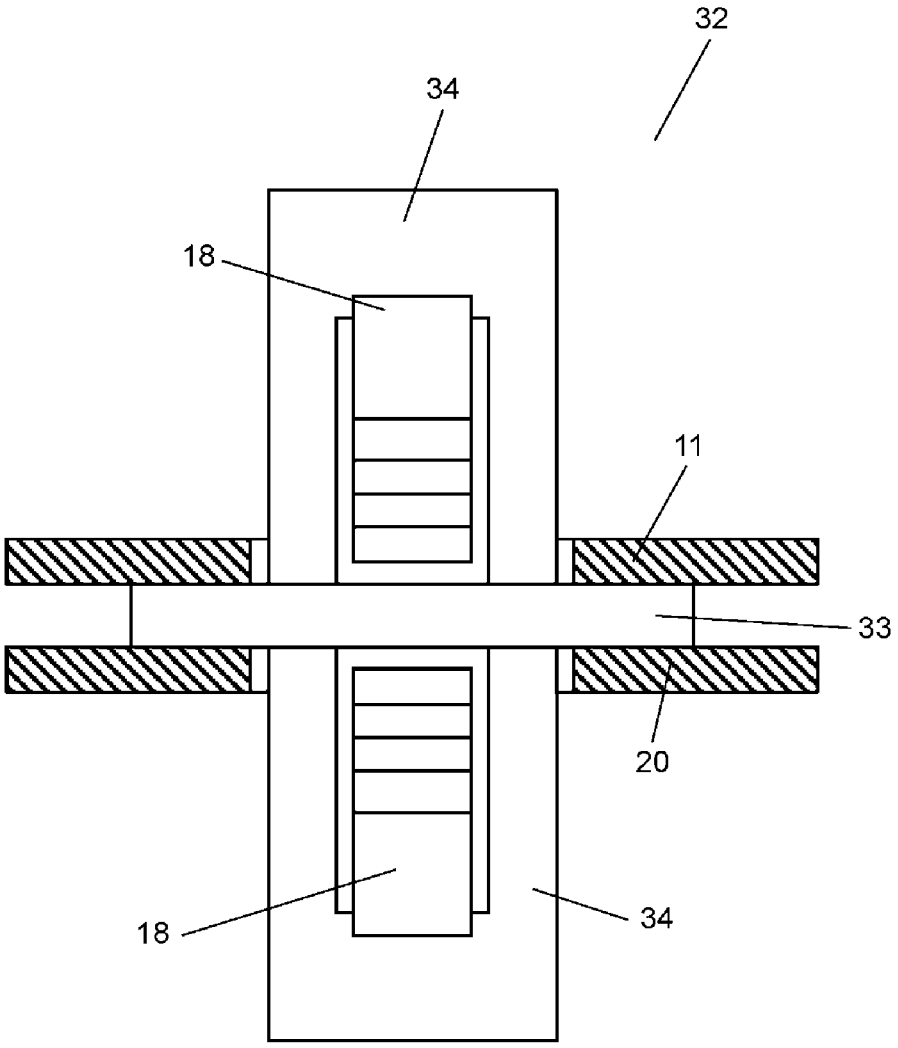
FIG. 7 is a side view illustrating an attachment unit of a loudspeaker according to a first variation.

In the exemplary embodiment, the description has been made with respect to the case where attachment unit 12 is formed of base portion 16 and cylindrical portion 17, base portion 16 is fixed to frame 11, and cylindrical portion 17 is fixed to structure 20 as an example. On the other hand, in the first variation, attachment unit 32 may be formed of; base plate 33; and cylindrical portions 34 disposed on both surface sides of base plate 33. FIG. 7 is a side view of an attachment unit of a speaker according to the first variation. In the first variation, in the same manner as the case described previously, locking portions 18 are disposed on respective cylindrical portions 34. The manner of operation when locking portions 18 receive a pressing force from the outside is also substantially equal to the corresponding manner of operation in the case described previously.

For example, in attachment unit 32 of the first variation, attachment unit 32 and frame 11 are fixed to each other by locking portion 18 (first locking portion) on an upper surface side of base plate 33 in the drawing. And attachment unit 32 and structure 20 are fixed to each other by locking portion 18 (second locking portion) on a lower surface side of base plate 33 in the drawing. That is, frame 11 and structure 20 are fixed to attachment unit 32 at positions extremely close to each other. With such a configuration, when frame 11 and structure 20 receive a force which causes a variation in positional relationship between frame 11 and structure 20 from the outside such that frame 11 shifts rightward in the drawing and structure 20 shifts leftward in the drawing, a stress generated in attachment unit 32 is suppressed and hence, the positional relationship between frame 11 and structure 20 can be maintained in a stable manner. This is because a fixing position of attachment unit 32 to frame 11 and a fixing position of attachment unit 32 to structure 20 are disposed close to each other and hence, a moment which acts on both fixing positions can be suppressed.

Second Variation

Figure 8:
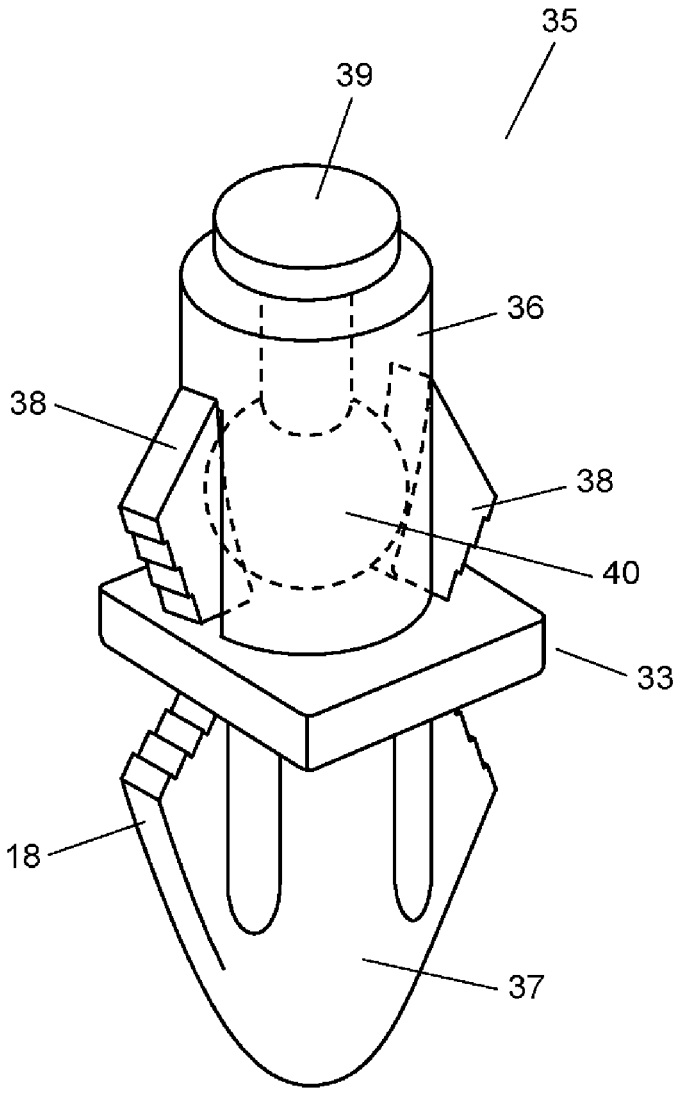
FIG. 8 is a perspective view illustrating a whole attachment unit of a loudspeaker according to a second variation.
Figure 9:
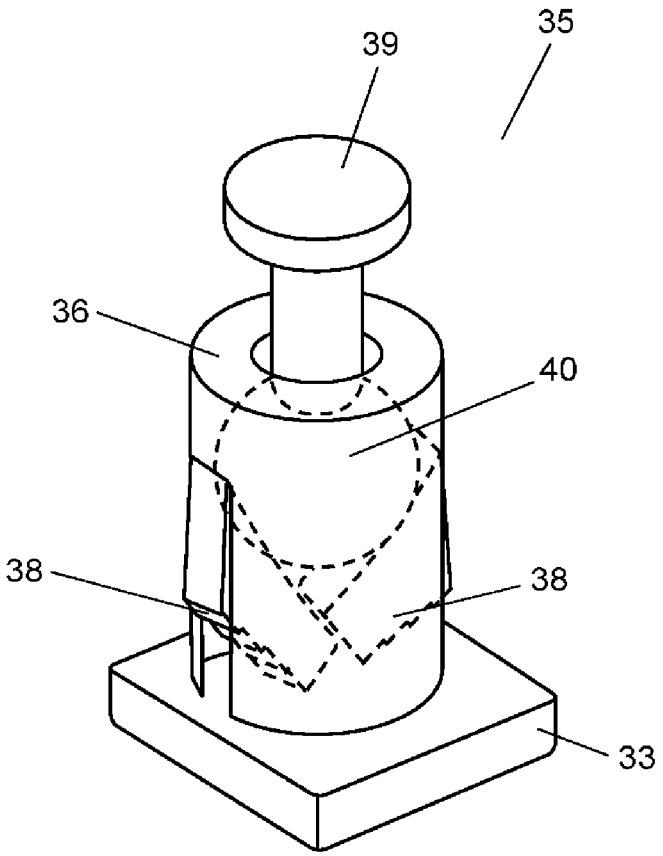
FIG. 9 is a partial perspective view illustrating the attachment unit of the loudspeaker according to the second variation.
Figure 10:
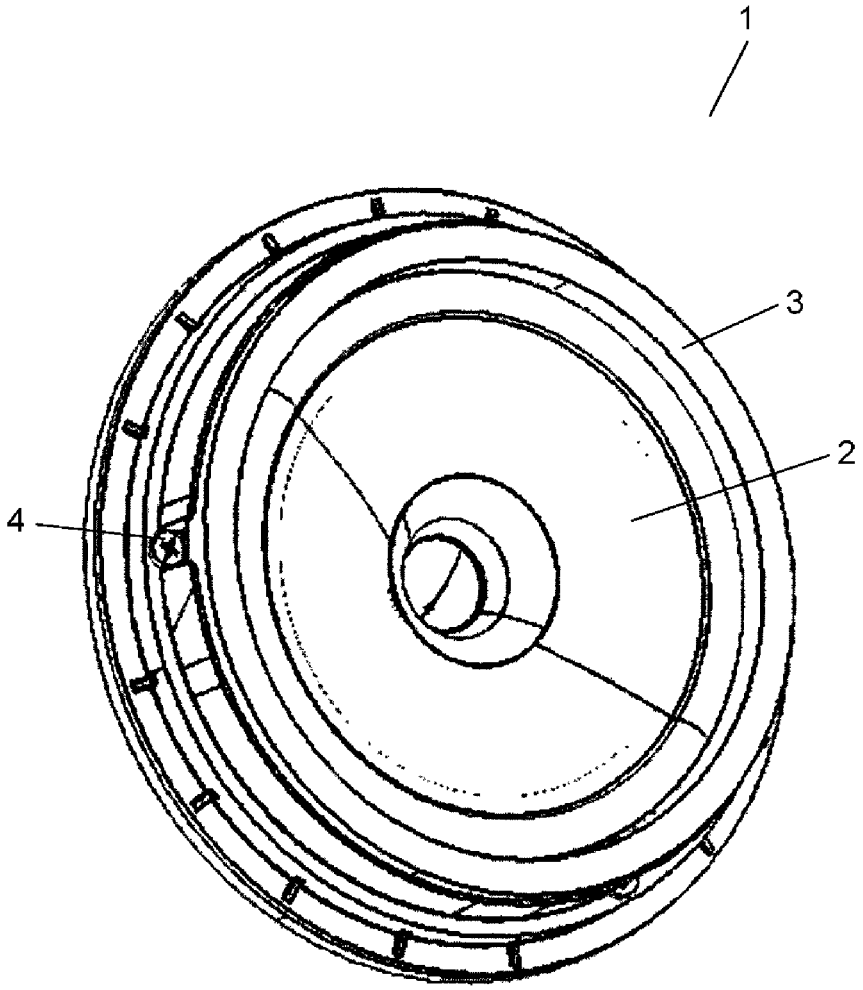
FIG. 10 is a perspective view illustrating a conventional speaker.
Figure 11:
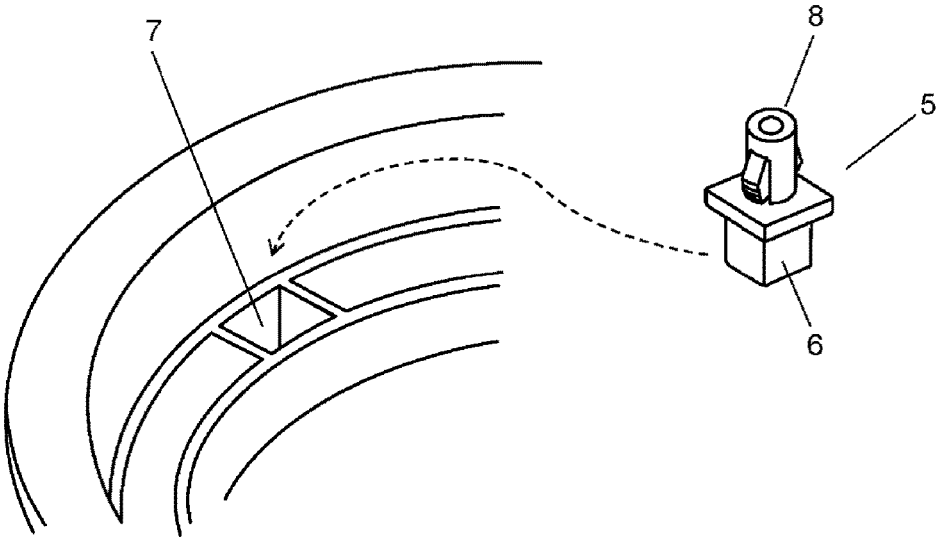
FIG. 11 is a perspective view illustrating a main part of the conventional speaker.

FIG. 8 is a perspective view illustrating the whole attachment unit of a loudspeaker according to a second variation, and FIG. 9 is a partial perspective view illustrating the attachment unit of the loudspeaker according to the second variation. As shown in FIG. 8 and FIG. 9, attachment unit 35 may be formed of; base plate 33; variable cylindrical portion 36 disposed on an upper surface side of base plate 33 in the drawing; and cylindrical portion 37 disposed on a lower surface side of base plate 33 in the drawing, and attachment unit 35 may have different functions between an upper surface side of base plate 33 and a lower surface side of base plate 33.

For example, in the same manner as the case described previously, cylindrical portion 37 disposed on the lower surface side of base plate 33 in the drawing is provided with locking portions 18. Further, the manner of operation when locking portions 18 receive a pressing force from the outside is also substantially equal to the corresponding manner of operation in the case described previously. On the other hand, in variable cylindrical portion 36 disposed on the upper surface side of base plate 33 in the drawing, variable locking portions 38 are controlled by adjusting pin 39 so as to be into a projecting state or into a housed state by adjusting pin 39. Connecting body 40 connected to adjusting pin 39 is housed in the inside of variable cylindrical portion 36. As shown in FIG. 8, in a state where adjusting pin 39 is pushed into variable cylindrical portion 36, variable locking portions 38 are brought into a projecting state by being pushed out by connecting body 40. On the other hand, as shown in FIG. 9, in a state where adjusting pin 39 is pulled out, variable locking portions 38 are not push out by connecting body 40 so that variable locking portions 38 are brought into a housed state. When variable locking portions 38 are in a projecting state, structure 20 and frame 11 can be fixed by sandwiching structure 20 and frame 11 by variable locking portions 38 and base plate 33. With such a configuration, attachment unit 35 can maintain a stable positional relationship between frame 11 and structure 20.

In the second variation, cylindrical portion 37 may have a waterproof function by being filled with a resin except for a variable region of locking portion 18. That is, variable cylindrical portion 36 and cylindrical portion 37 may be shut off from each other with base plate 33 interposed therebetween as a boundary so as to prevent the intrusion of a liquid or the like from each other. For example, in fixing loudspeaker 9 to structure 20, when loudspeaker 9 is disposed in the inside of a room and structure 20 is disposed outside the room so that cylindrical portion 37 is exposed to moisture and the like, it is desirable that cylindrical portion 37 or base plate 33 shuts off the intrusion of moisture.

The loudspeaker and the loudspeaker structure according to this disclosure can acquire an advantageous effect that it is possible to prevent a fixed state of the attachment unit from becoming inappropriate, and are effectively used in various electronic devices.

What is claimed is:

1. A loudspeaker comprising:

a diaphragm;

a frame having a front surface, a mounting surface disposed on a side opposite to the front surface, and a wall surface disposed in a standing manner from the mounting surface, the frame holding an outer peripheral edge of the diaphragm;

an attachment unit including:

a base portion having a top surface facing the mounting surface, a bottom surface disposed on a side opposite to the top surface, a first side surface facing the wall surface, and a second side surface disposed on a side opposite to the first side surface;

a first base rib projecting toward the wall surface from the first side surface;

a second base rib projecting from the second side surface and extending to the top surface; and a locking portion disposed on a side near the bottom surface of the base portion; and a fixing member penetrating the frame from the front surface to the mounting surface, the fixing member being fixed to the base portion by screwing, wherein:

the first base rib is in contact with the wall surface, and the second base rib is in contact with the mounting surface.

2. The loudspeaker according to claim 1, wherein:

the attachment unit has a cylindrical portion disposed in a standing manner from the bottom surface, and the locking portion projects from a side surface of the cylindrical portion.

3. The loudspeaker according to claim 1, wherein a projection amount of the second base rib is larger than a projection amount of the first base rib.

4. The loudspeaker according to claim 1, wherein:

the wall surface has a wall surface rib, and the wall surface rib projects toward the base portion.

5. The loudspeaker according to claim 4, wherein the wall surface rib is in contact with the base portion.

6. A loudspeaker structure comprising:

a diaphragm;

a frame having a front surface, a mounting surface disposed on a side opposite to the front surface, and a wall surface disposed in a standing manner from the mounting surface, the frame holding an outer peripheral edge of the diaphragm;

an attachment unit including:

a base portion having a top surface facing the mounting surface, a bottom surface disposed on a side opposite to the top surface, a first side surface facing the wall surface, and a second side surface disposed on a side opposite to the first side surface;

a first base rib projecting toward the wall surface from the first side surface;

a second base rib projecting from the second side surface and extending to the top surface; and a locking portion disposed on a side near the bottom surface of the base portion;

a fixing member penetrating the frame from the front surface to the mounting surface, the fixing member being fixed to the base portion by screwing; and a plate-shaped structural portion having an attachment hole into which the locking portion is inserted, wherein:

the first base rib is in contact with the wall surface, and the second base rib is in contact with the mounting surface.

7. A loudspeaker comprising:

a diaphragm;

a frame having a front surface and a mounting surface disposed on a side opposite to the front surface, the frame holding an outer peripheral edge of the diaphragm; and an attachment unit including:

a base portion having a top surface facing the mounting surface and a bottom surface disposed on a side opposite to the top surface;

a first locking portion disposed on a side near the top surface of the base portion; and a second locking portion disposed on a side near the bottom surface of the base portion, wherein:

the attachment unit further includes:

a cylindrical portion disposed in a standing manner from the top surface; and a connecting body disposed inside the cylindrical portion, and the first locking portion projects from a side surface of the cylindrical portion, and a projection amount of the first locking portion is changeable by adjusting a position of the connecting body inside the cylindrical portion.

* * * * *